US005472035A

United States Patent [19]

Biba et al.

[11] Patent Number: 5,472,035

[45] Date of Patent: Dec. 5, 1995

[54] WINDOW BLIND WITH WAND OPERATOR

[75] Inventors: Scott I. Biba, Mazomanie; John R. Genova, Madison, both of Wis.

[73] Assignee: Springs Window Fashions Division, Inc., Middleton, Wis.

[21] Appl. No.: 266,125

[22] Filed: Jun. 27, 1994

[51] Int. Cl.[6] ..... E06B 9/30

[52] U.S. Cl. ..... 160/168.1; 160/178.1; 74/502

[58] Field of Search ..... 160/168.1 R, 168.1 V, 160/177 V, 177 R, 176.1 R, 176.1 V, 178.1 V, 178.1 R , 178.2 R, 319, 320, 321; 16/216, 217, 219; 254/385, 386; 74/502

[56] References Cited

U.S. PATENT DOCUMENTS 2,116,357 5/1938 Laborda et al. .
2,410,549 11/1946 Olson .
3,633,646 1/1972 Zilver .
5,038,843 8/1991 Sommerfeld ..... 160/168.1 V X
5,092,383 3/1992 Niemeijer et al. ..... 160/168.1 R X

*Primary Examiner*—Blair M. Johnson
*Attorney, Agent, or Firm*—Vernon J. Pillote

[57] ABSTRACT

A venetian type window blind having a wand which is rotatable to control tilting of slats and lift cord operating mechanism on the wand for raising and lowering the blind and locking the blind in adjusted positions. The venetian blind lift cords extend into a lengthwise cord passage inside the wand and the lift cord operating mechanism includes a lift member mounted for movement along an outer side of the wand and lift cord, an engaging member in the cord passage for moving the lift cords to raise and lower the blind in response to movement of the lift member along the wand. The operating means includes lock means for locking the lift cord engaging member at selected positions along the wand.

25 Claims, 4 Drawing Sheets

FIG. 6
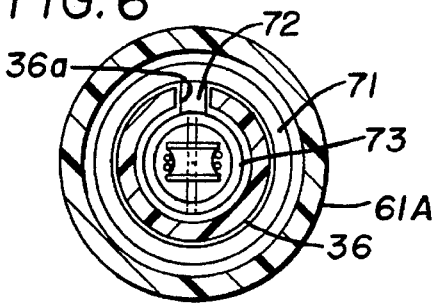
FIG. 8
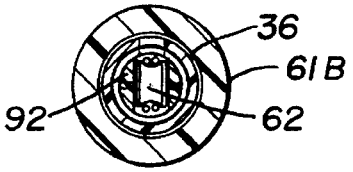
FIG. 5
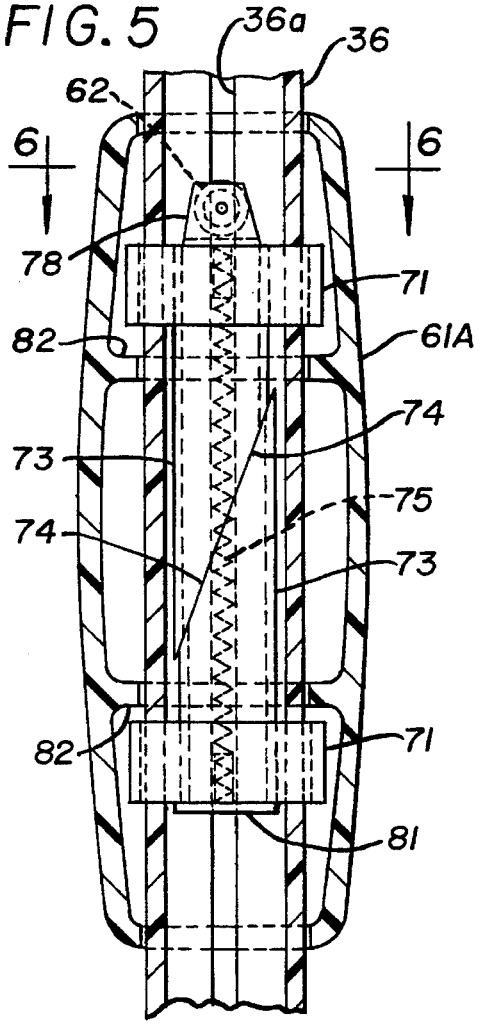
FIG. 7
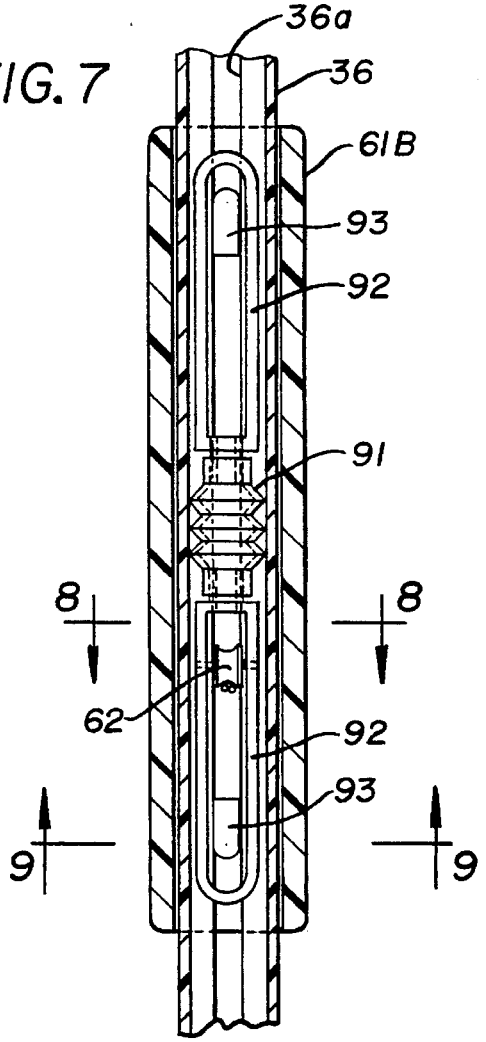
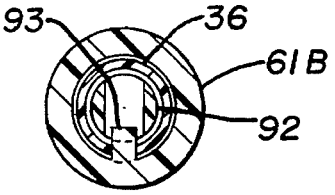
FIG. 9

FIG. 11
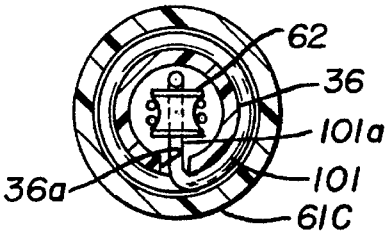
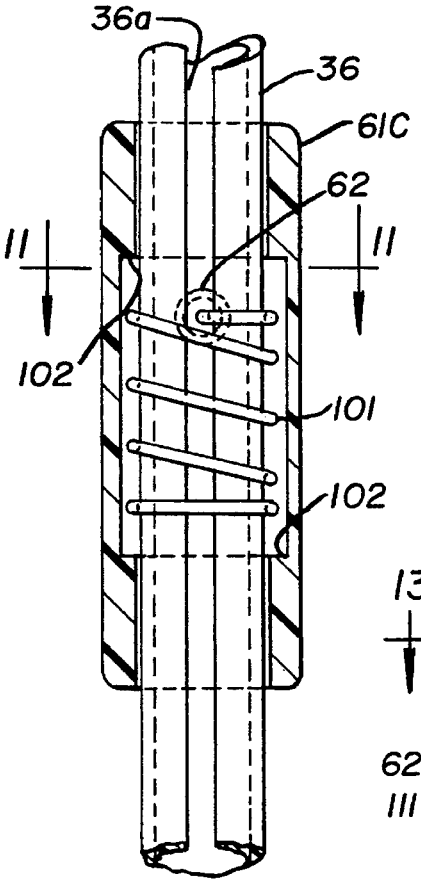
FIG. 10
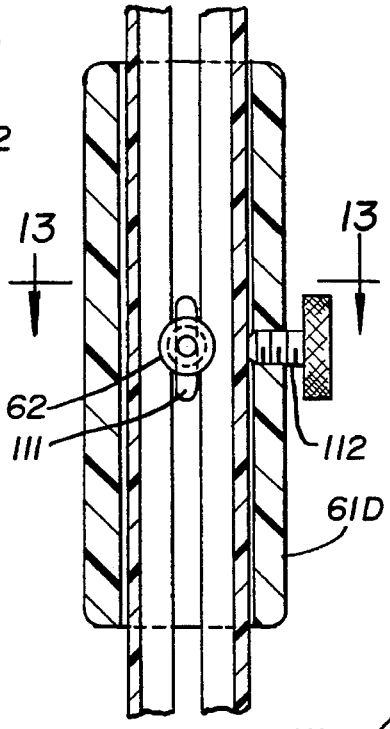
FIG. 12
FIG. 15
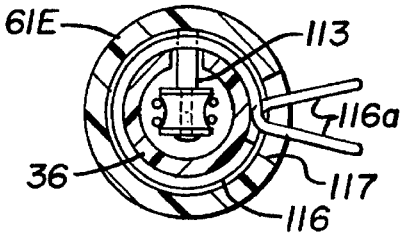
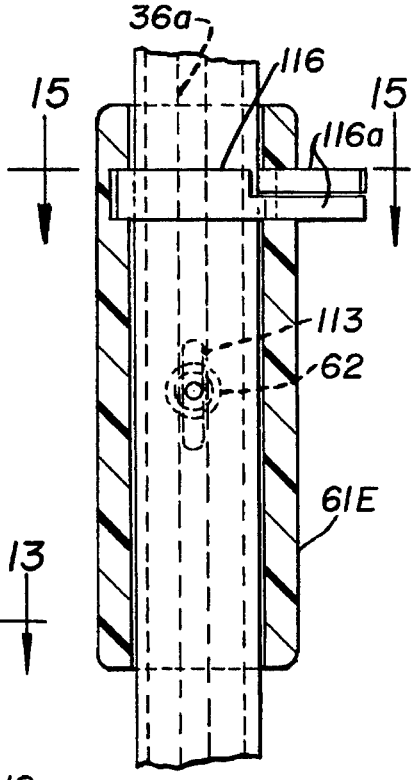
FIG. 14
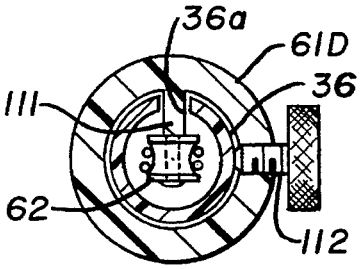
FIG. 13

WINDOW BLIND WITH WAND OPERATOR

BACKGROUND OF THE INVENTION

U.S. Pat. Nos. 2,116,357; 2,410,549 and 3,633,646 disclose venetian blinds having a wand type operator for tilting the blind slats and in which the lift cords for raising the blind extend through the wand. In U.S. Pat. No. 2,116,357, the wand is connected to a lever attached to the headrail of a venetian blind to tilt the headrail in response to lengthwise movement of the wand, and the lift cords extend downwardly through the wand and out of the lower end to enable the lower ends of the lift cords to be manipulated by hand to raise and lower the blind. U.S. Pat. No. 2,410,549 uses a cord and pulley arrangement for tilting the slats in response to turning of the wand and the operating ends of the lift cords are attached to the lower end of the wand so that the lower portion of the wand must be detached and moved to raise and lower the blind. U.S. Pat. No. 3,633,646 discloses a wand connected to the tilt mechanism through a worm and worm gear drive so that the slats can be tilted in response to rotation of the wand. In this patent, the lift cords extend downwardly through the wand and out of the lower end to enable the lower ends of the lift cords to be manipulated by hand for raising and lowering the blind, and a cord lock provided at the lower end of the wand to lock the cords to the lower end of the wand. In each of these patents, the lift cords extend out from the lower end of the wand a distance at least equal to the height of the blind to enable hand control of the cords during movement of the blind from a fully lowered to a fully raised condition. The dangling ends of the lift cords are not only aesthetically undesirable but also present a potential safety hazard to children that can reach and play with such cords. Further, in the above patents, the blind is secured in adjusted position by gripping or pinching the lift cords and this tends to cause wear and damage to the lift cords.

SUMMARY OF THE INVENTION

It is a general object of the present invention to overcome the problems of the prior art window blinds having lift cords for raising and lowering the blind, by providing an improved cord operating mechanism in which the operating portions of the lift cords are enclosed within a wand that extends downwardly from the headrail and in which manually operable cord operating means are movable along the wand to raise and lower the blind and to lock the blind in an adjusted position.

Another object of this invention is to provide a venetian blind having an improved cord operating mechanism in accordance with the foregoing object for raising and lowering blind, and in which the wand that is also rotatable about its lengthwise axis to change the tilt of the slats for light control.

BRIEF DESCRIPTION OF THE DRAWINGS

FIG. 5 is a longitudinal sectional view illustrating a first embodiment of a lift cord operating mechanism;

FIG. 6 is a transverse sectional view taken on the plane 6—6 of FIG. 5;

FIG. 7 is a longitudinal sectional view of the second embodiment of a lift cord operating mechanism;

FIG. 8 is a transverse sectional view taken on the plane 8—8 of FIG. 7;

FIG. 9 is transverse sectional view taken on the plane 9—9 of FIG. 7;

FIG. 10 is a longitudinal sectional view illustrating a third embodiment of lift cord operating mechanism;

FIG. 11 is a transverse sectional view taken on the plane 11—11 of FIG. 10;

FIG. 12 is a longitudinal sectional view illustrating a fourth embodiment of the lift cord operating mechanism;

FIG. 13 is a transverse sectional view taken on the plane 13—13 of FIG. 12;

FIG. 14 is a longitudinal sectional view illustrating a fifth embodiment of a lift cord mechanism; and FIG. 15 is a transverse sectional view taken on the plane 15—15 of FIG. 14.

DETAILED DESCRIPTION

Figure 1:
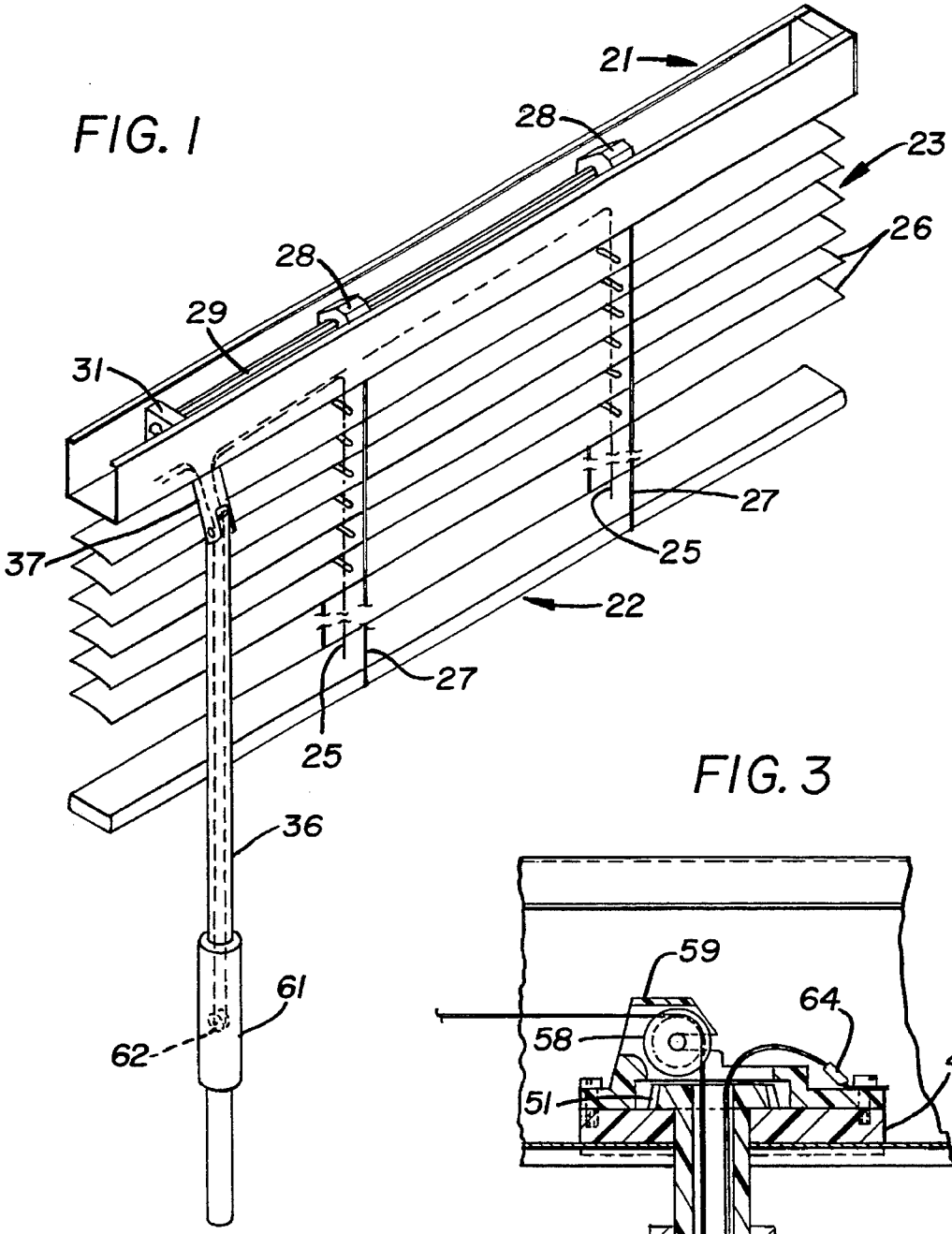
FIG. 1 is a perspective view of a blind embodying the present invention.

The invention relates to window blinds of the type having a headrail generally indicated by the numeral 21, a bottom rail 22, expandable and collapsible shade means 23 extending between the headrail and bottom rail, and lift cords 25 that are connected at their lower ends to the bottom rail and which extend upwardly through or alongside the slats into the head rail. In the preferred embodiment illustrated, the window blind is of the venetian blind type having a plurality of slats 26 supported on flexible ladders 27. As is conventional, the ladders 27 each include spaced cords or tapes with slat supports extending therebetween. A slat tilt device 28 is provided at the upper end of each of the ladders for relatively moving the spaced cords or tapes to tilt the slats for light control, and the tilt devices 28 are interconnected as by a rod 29 for simultaneous movement by a slat tilt operating mechanism 31.

Figure 2:
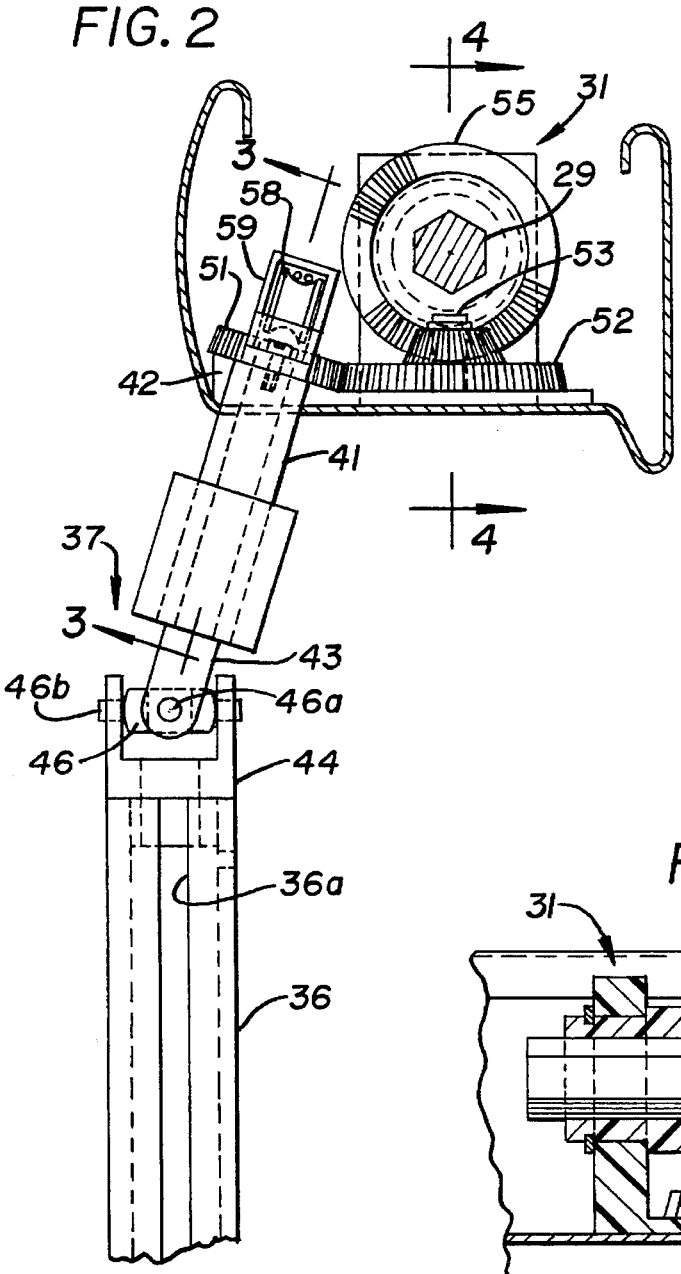
FIG. 2 is a transverse sectional view taken on the plane 2—2 of FIG. 1 and illustrating parts on a larger scale than FIG. 1.

A window blind control means is provided for controlling tilting of the slats and for raising and lowering the bottom rail. In general, the control means includes an elongated wand 36 having a lengthwise extending internal wand passage that opens at a slot **36*a* along one side of the wand, and wand connector means 37 for mounting the upper end of the wand on the headrail 21. The wand is of tubular configuration and is herein shown having a circular cross-section, it being understood that the wand could have other cross-sectional configurations such as oval or polygonal. The wand connector means is arranged to swingably support the wand on the headrail and to also provide a cord passage that extends between the headrail and the upper end of the internal wand passage. As best shown in FIG. 2, the wand connector means includes a tubular drive stem 41 mounted on a support base 42 in the headrail for rotation about a downwardly and forwardly inclined axis, and a universal joint of the type having a first yoke 43 rotatably attached to the stem 41, a second yoke 44 rotatably attached to the upper end of the wand 36, and an intermediate joint member 46. The intermediate joint member has first and second orthogonally disposed pivots 46*a* and 46*b* that are respectively connected to the first and second yokes 43 and 44. The yokes 43 and 44 and the intermediate joint member 46 each have an axial passage therethrough so that the lift cords can pass through the stem 44** and through the universal joint into the wand.

Figure 3:
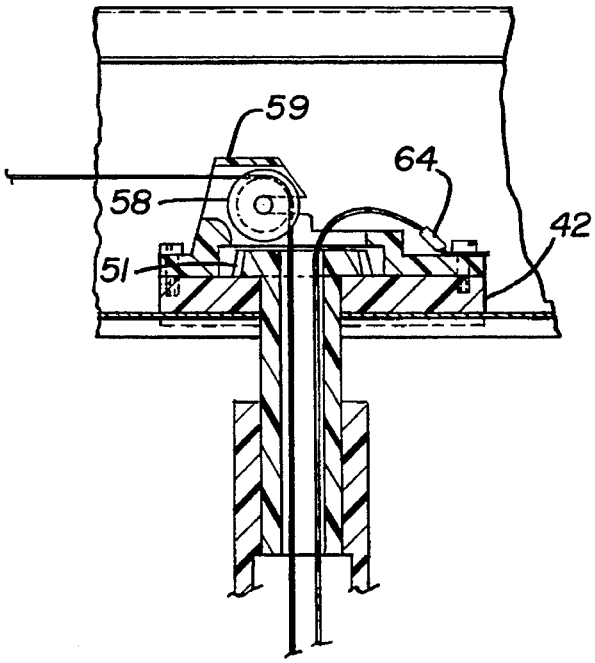
FIG. 3 is a fragmentary sectional view taken on the plane 3—3 of FIG. 2.
Figure 4:
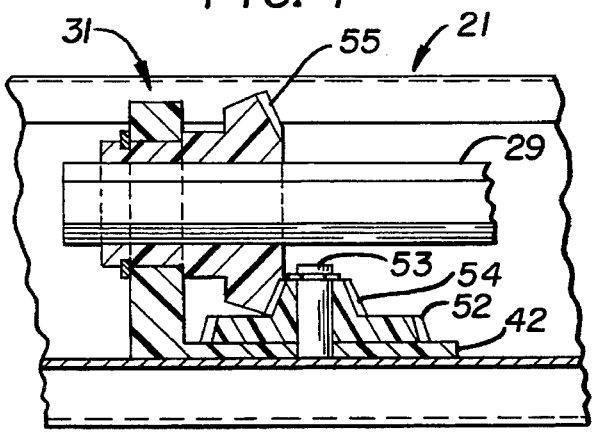
FIG. 4 is a fragmentary sectional view taken on the plane 4—4 of FIG. 2.

The wand is operatively connected to the slat tilt operating mechanism 31 to effect tilting of the slats in response to rotation of the wand about its lengthwise axis. As described more fully hereinafter, the lift cords are guided from the headrail into the upper end of the wand connector means and the driving connection between the wand connector means and the slat tilt operating mechanism is advantageously arranged so that the lift cords can enter and exit from the upper end of the wand connector means at a location adjacent the bottom wall of the headrail. The drive connection between the wand connector and the slat tilt operating mechanism is best shown in FIGS. 2–4 and includes a bevel gear 51 formed on the upper end of the tubular drive stem, and which meshes with a bevel gear 52 rotatably supported on the base at a location adjacent the bottom wall of the headrail. The bevel gear 52 is mounted on a pin 53 for rotation about an upright axis transverse to the rod 29 and has a bevel gear 54 that meshes with a bevel gear 55 on the rod. The size of the gears 51, 52, 53, and 55 is preferably selected so as to provide a turn ratio, for example about 4 to 1 between wand turns and turns of the shaft 29, to enable accurate adjustment of the tilt angle and to hold the slats in the adjusted position.

As best shown in FIG. 1 the lift cords 25 extend upwardly from the bottom rail through openings to the slats and into the headrail 21 through openings in the bottom thereof and then pass lengthwise of the headrail to the upper end of the wand connector. Static type or pulley type guides are provided for guiding the cord from the vertical run through the blind to the horizontal runs in the headrail and, as best shown in FIGS. 2 and 3, a pulley 58 is mounted by a bracket 59 at the upper end of the wand connector to guide the cords as they pass from the horizontally extending run downwardly into the wand. The gear arrangement previously described enables the pulley to be positioned so that the horizontal runs of the lift cords extend relatively close to the bottom wall of the headrail to minimize the likelihood of interference between the lift cords and the slat tilt mechanisms 28.

Manually operable lift cord operating means are provided on the wand for operating the lift cords to raise and lower the blind and for locking the blind in the adjusted positions. The lift cord operating means includes a lift member 61 mounted for movement along the outer side of the wand 36, and lift cord engaging means 62 inside the wand passage and operatively connected to the lift member 61 through the slot **36*a* in the wand, for moving the lift cord means to raise and lower the bottom rail in response to movement of the lift member along the wand. The lift cord engaging means can be fixedly attached to ends of the lift cord so as to raise and lower the lift cord on a 1 to 1 ratio with the movement of the lift member along the wand. However, it is preferable and advantageous to arrange the cord engaging means 62 as a cord return guide, such as a pulley, and to extend the lift cords from the horizontal runs in the headrail downwardly in the wand passage and around the lift cord guide and then upwardly in the lift cord passage, with the upper ends of the lift cords anchored adjacent at upper end of the wand. The upper ends of the lift cords can be anchored as shown at 64 in FIG. 3, at a location inside the headrail. It is deemed apparent that the upper ends of the lift cords could also be anchored to the upper end of the wand, for example by extending the ends of the lift cords through a lateral opening 64*a* adjacent the upper end of the wand, with the lift cords anchored as by knots on the outer ends of the lift cords. As will be seen, arranging the lift cords so that they form a loop in the wand with the cord return guide 62 engaging the lower end of the loop, effects raising and lowering of the blind with a 2 to 1 ratio, that is with the upward and downward movement of the bottom rail being 2 times the movement of the lift member 61** along the wand.

The lift cord operating means also includes lock means for locking the lift cord engaging means at selected positions along the wand. In the embodiment of FIGS. 5 and 6, the locking means is in the form of a pair of annular members 71 that extend around the outer side of the wand 36 and which are each integrally connected by a lug 72 to an axially elongated tubular member 73 disposed inside the wand. As shown in FIG. 5, the axially elongated tubular members 73 have interengaging cam faces 74 on adjacent ends thereof. The annular members 71 are dimensioned to slidably surround the outer side of the wand when the elongated members 73 are disposed in substantial axial alignment, and the members 71 are tiltable in a direction crosswise of the wand into frictional engagement therewith by the cam surfaces 74, when the members 71 are drawn toward each other. A means such as a tension spring 75 is provided to resiliently interconnect the members 71 to draw the members toward each other and cam the members 73 into frictional engagement with the outer side of the wand. The lift cord operating member 62 is operatively connected to the lower one of the annular lock members 71 so that the upward force on the lift cord engaging means 62 provided by tension in the lift cords draws the lower member upwardly with a force correlative with the tension in the lift cords to increase frictional engagement of the lock member 71 with the outer surface of the wand. For this purpose, the lift cord engaging member 62 is mounted on a pulley housing 78 located above the upper lock member 71 and connected by a wire (not shown) that extends down through the tension spring 75, with the lower end of the wire connected to a head 81 that underlies the lower lock member 71. In this embodiment, the manually operable lift member 61A is provided with inwardly extending upper and lower ribs 82 that respectively underlie and overlie the upper and lower lock members 71 and are normally spaced a short distance from the lock members sufficient to allow tilting of the lock members. The upper rib 82 is arranged to engage the upper lock member and move the latter upwardly and release the cam action when the lift member 61A is raised and, similarly, the lower rib 82 is arranged to engage the lower lock member 71 when the lift member is moved downwardly, to release the cam action. Thus, the lock means in the embodiment of FIG. 5 and 6 is operative in response to a force applied manually to the lift member in either direction lengthwise of the wand, for moving the cam means in a direction to reduce tilting of the upper and lower lock members relative to the wand.

FIGS. 7–9 illustrate the presently preferred embodiment of the lift cord operating mechanism. In this embodiment the lift cord operating mechanism comprises a resilient axially expansible and contractable member 91 disposed inside the wand, and upper and lower actuator members 92 respectively attached to the upper and lower ends of the member 91. The member 91 is formed of a resilient material such as rubber or the like and preferably has a bellows like configuration as shown in FIG. 7. The member 91 is disposed in sliding frictional engagement with the inner side of the wand and radially expands when axially compressed, to increase the frictional engagement with the wand. The lift cord engaging member is operatively connected to the lower one of the actuators 92 so as to axially compress the member 91 in a direction lengthwise of the wand with a force correlative with the tension in the lift cords, and thereby radially expand the member 91 into increased frictional engagement with the wand. As shown in FIG. 2, the cord engaging member 62 is rotatably mounted on the lower one of the actuator members 92 to apply the upward tension on the lift cords to the lower actuator member.

The actuator members 92 are herein shown in the form of generally U-shaped yokes, and upper and lower lugs 93 are provided on the lift member 61B and arranged to extend through the slot 36*a* in the wand into the upper and lower U-shaped yokes. The upper and lower lugs are normally spaced from the upper and lower ends of the U-shaped yokes and are operative when the lift member 61 is moved upwardly relative to the wand to engage the upper yoke and axially extend the member 91 to radially contract the latter and allow upward movement of the lift cord operating means along the wand. Similarly, the lower lug 93 is arranged to engage the end of the lower yoke 93 to axially extend and radially contract the member 91, to allow downwardly movement of the lift cord operating means relative to the wand.

A third embodiment of cord operating means is illustrated in FIGS. 10 and 11. In this embodiment, the locking member is in the form of a coil spring 101 disposed around the outside of the wand and having an inside diameter slightly smaller than the outside diameter of the wand so that the spring is normally disposed in frictional engagement with the wand. The lift cord engaging means is operatively connected to an upper end of the coil spring 101 and may, for example, be attached to a laterally extending portion 101*a* on the upper end of the spring, which portion extends through the slot 36*a* in the wand as best shown in FIG. 11. The spring 101 radially expands when axially compressed and conversely radially contracts when axially extended. The upward tension on the lift cords is applied through the cord engaging member to the upper end of the spring so as to axially extend the spring and increase frictional engagement with the wand. The lift member 61C surrounds the spring and has upper and lower inwardly extending shoulders 102 that are spaced apart a distance greater than the axial length of the spring 101. When the lift member 61 is manually moved upwardly, the lower shoulder 102 engages the lower end of the spring to reduce axial extension of the spring and decrease frictional engagement with the wand at least sufficient to allow movement of the lift cord engaging member upwardly on the wand. Similarly, when the lift member 61 is manually moved downwardly relative to the wand, the upper shoulder 102 engages the upper end of the spring to reduce axial extension of the spring and decrease frictional engagement with the wand at least sufficient to allow movement of the lift cord operating means downwardly along the wand.

In the embodiment of FIG. 12, the cord engaging member 62 is mounted on a lug 111 that is rigid with the outer lift member 61D. The lock means is in the form of a finger manipulatable member such as a thumb screw 112 that is threadedly mounted on the lift member 61 and is arranged to engage the outer side of the wand and increase frictional engagement between the wand and the lift member sufficient to lock the lift cord engaging member in adjusted position along the wand.

In the embodiment of FIGS. 14 and 15, the lift cord engaging member is also mounted on a lug 113 that is fixed to the lift member 61E and extends through the slot in the wand 36. In this embodiment, the lock means is in the form of a clamp spring 116 having a normal inside diameter smaller than the outside diameter of the wand to frictionally engage the wand. The clamp spring has ears 116*a* that project through an opening 117 in the lift member 61, so that the frictional engagement of the clamp spring with the outer side of the wand can be released by applying finger pressure to the ears 116*a*. The clamp spring 116 is disposed in a recess 119 in the inner surface of the lift member such that the clamp ring moves with the lift member along the wand. Thus, the lift cords can be adjusted by applying finger pressure to the ears 116*a* while moving the lift member 61E along the wand.

From the foregoing, it is believed that the construction and operation of the wand operated blind will be readily understood. In the venetian blind illustrated, the wand is rotatable about its lengthwise axis to adjust the tilt of the slats of the blind. The lift cords have an operating portion that extends into the wand and the lift cord operating means includes a lift member mounted for movement along an outer side of the wand and a lift cord engaging means inside of the wand for moving the lift cords to raise and lower the blind in response to moving of the lift member along the wand. The lift cord operating means also includes a lock means for locking the lift cord engaging means at selected positions along the wand. With this arrangement, the operating portions of the lift cords are enclosed within the wand so that there are no dangling cords in which a child could become entangled. The lift cord operating means also facilitates raising and lowering of the blind and locking the blind in adjusted position. In each of the embodiments, the locking means are arranged to frictionally engage the wand at either the inner or outer side of the wand. In the embodiments of FIGS. 5, 7 and 10, the lift cord operating means includes means responsive to the force applied manually to the lift member in either direction lengthwise of the wand for releasing the lock means at least sufficient to allow movement of the lift cord operating means along the wand. Further, in these embodiments the upward tension on the lift cord means is applied to the lock means in a manner to increase frictional engagement of the lock means with the wand. Thus, as the blind is raised, the portion of the blind that is supported by the lift cords increases and this increases the frictional locking force for holding the blind in its raised position. In the embodiments of FIGS. 12 and 14, finger manipulatable means are provided on the lift member for selectively locking the cord the cord engaging means to the wand. Thus, in each of the embodiments, the lift cord operating means can be manipulated by one hand to only raise and lower the blind but also lock the blind in adjusted position. While the lift cord operating means is herein shown applied to a venetian blind, it is deemed apparent that the lift cord operating means could also be advantageously used on other window blinds having an expansible and collapsible blind member between the headrail and bottom rail, raise and lower the blind and lock the blind in adjusted position.

The embodiments of the invention in which an exclusive property or privilege is claimed are defined as follows:

1. A window blind comprising, a headrail, a bottom rail, flexible ladder means between the bottom rail and headrail and supporting a plurality of slats, lift cord means having one end connected to the bottom rail and extending from the bottom rail into the headrail, control means for tilting the slats and for raising and lowering the bottom rail, said control means including an elongated wand having lengthwise extending wand passage means opening along one side of the wand and wand connector means for mounting the upper end of the wand on the headrail for turning relative thereto, slat tilt operating means connected to the ladder means and responsive to turning of the wand for tilting the slats, the wand connector means providing cord passage means between the headrail and an upper end of the wand passage means, the lift cord means extending from the headrail through the cord passage means in the wand connector means and downwardly into the wand passage means, manually operable lift cord operating means including a lift member mounted for movement along an outer side of the wand and lift cord engaging means inside the wand passage for moving the lift cord means to raise and lower the bottom rail in response to movement of the lift member along the wand, the lift cord operating means including lock means for locking the lift cord engaging means at selected positions along the wand.

2. A window blind according to claim 1 wherein the lift cord engaging means includes a cord return guide means, the lift cord means extending downwardly in the wand passage and around the cord return guide means and then upwardly in the wand passage and having a second end, and means for anchoring the second end of the lift cord means against movement in a direction lengthwise of the wand whereby movement of the lift cord actuating means along the wand produces an amplified travel of the bottom rail.

3. A window blind apparatus according to claim 2 wherein said anchor means attaches the second end of the lift cord means to said headrail.

4. A window blind apparatus according to claim 2 wherein said anchor means attaches the second end of the lift cord means to an upper portion of said wand.

5. A window blind apparatus according to claim 1 wherein said wand connector means includes a universal joint of the type having first and second yokes connected at pivots to an intermediate member, the cord passage means in the wand connector means extending axially through the yokes and the intermediate member.

6. A window blind according to claim 1 wherein said slat tilt operating means includes a rod extending lengthwise of the headrail, said wand connector means including a tubular drive stem rotatably mounted in the headrail and having a gear on its upper end adjacent a bottom of the headrail and in meshing engagement with a second gear disposed below the rod, and gear means operatively connecting the second gear to the gear on said rod for turning the latter in response to turning of the drive stem, said lift cords extending through said tubular drive stem.

7. A window blind according to claim 1 wherein said lock means comprises means for engaging the outer side of the wand.

8. A window blind according to claim 1 wherein said lock means comprises means in the wand passage means for engaging an inner side of the wand.

9. A window blind according to claim 1 wherein the lock means includes means for frictionally engaging a lengthwise extending surface on the wand.

10. A window blind according to claim 1 wherein said lift cord operating means includes means responsive to a force applied manually to the lift member in either direction lengthwise of the wand for releasing the lock means at least sufficient to allow movement of the lift cord operating means along the wand.

11. A window blind according to claim 1 wherein the lock means includes means for frictionally engaging a lengthwise extending surface on the wand, said lift cord operating means including means responsive to a force applied manually to the lift member in a direction lengthwise of the wand for releasing the lock means at least sufficient to allow movement of the lift cord operating means along the wand.

12. A window blind according to claim 11 wherein the means for frictionally engaging a lengthwise extending surface of the wand includes a device disposed inside the wand and which is expansible in a direction crosswise of the wand.

13. A window blind according to claim 12 including means operatively connecting the lift cord means to the device to expand the device with a force that increases with increasing tension on the lift cord means.

14. A window blind according to claim 11 wherein the means for frictionally engaging a lengthwise extending surface of the wand includes a device disposed outside the wand and which is contractable in a direction crosswise of the wand.

15. A window blind according to claim 14 including means operatively connecting the lift cord means to the device to contract the device with a force that increases with increasing tension in the lift cord means.

16. A window blind according to claim 1 wherein the lock means includes upper and lower devices tiltable relative to the wand into and out of engagement with the wand, cam means for tilting the upper and lower devices relative to the wand and means for yieldably urging the cam means in a direction to tilt the upper and lower devices into frictional engagement with the wand.

17. A window blind according to claim 16 wherein said lift cord operating means includes means responsive to a force applied manually to the lift member in a direction lengthwise of the wand for moving the cam means in a direction to reduce tilting of the upper and lower devices relative to the wand.

18. A window blind according to claim 1 wherein said lock means comprises means for frictionally engaging a lengthwise extending surface of the wand, means responsive to an upward force on the lift cord engaging means provided by tension in the lift cord means for increasing the frictional engagement of the lock means with the wand, and means responsive to a manually applied downward force on the lift member for decreasing the frictional engagement of the lock means with the wand at least sufficient to allow movement of the lift cord operating means along the wand.

19. A window blind according to claim 1 wherein the lock means includes a resilient device disposed inside the wand passage in sliding frictional engagement with the wand and which is expansible in a radial direction crosswise of the wand passage in response to compression in a direction lengthwise of the wand passage, means operatively connecting the lift cord engaging means to a lower end of the device to compress the device in a direction lengthwise of the wand with force correlative with tension on the lift cord means to a locking condition, and means responsive to a manually applied downward force on the lift member for releasing compression on the device and decreasing frictional engagement with the wand at least sufficient to allow movement of the lift cord operating means along the wand.

20. A window blind according to claim 1 wherein the lock means includes a resilient coil spring device disposed around the wand in sliding frictional engagement therewith and which is contractable in a radial direction crosswise of the wand in response to axial extension in a direction lengthwise of the wand, means operatively connecting the lift cord engaging means to an upper end of the device to axially extend and radially contract the device with a force correlative with the tension on the lift cord means, and means responsive to a manually applied downward force on the lift member for releasing axial extension of the device and decreasing frictional engagement with the wand at least sufficient to allow movement of the lift cord operating means along the wand.

21. A window blind comprising, a headrail, a bottom rail, expansible and collapsible shade means between the bottom rail and headrail, lift cord means having one end connected to the bottom rail and extending from the bottom rail into the head rail, control means for raising and lowering the bottom rail, said control means including an elongated wand having lengthwise extending wand passage means opening along one side of the wand and wand connector means for swingably connecting the upper end of the wand on the headrail, the wand connector means providing cord passage means between the headrail and an upper end of the wand passage means, the lift cord means extending from the headrail through the cord passage means in the wand connector means and downwardly into the wand passage means, manually operable lift cord operating means including a lift member mounted for movement along an outer side of the wand and lift cord return guide means inside the wand passage for moving the lift cord means to raise and lower the bottom rail in response to movement of the lift member along the wand, the lift cord means extending downwardly in the wand passage and around the cord return guide means and then upwardly in the wand passage, and means for anchoring a second end of the lift cord means against movement in a direction lengthwise of the wand whereby movement of the lift cord actuating means along the wand produces an amplified travel of the bottom rail, the lift cord operating means including lock means for locking the lift cord engaging means at selected positions along the wand.

22. A window blind according to claim 21 wherein said lock means comprises means for frictionally engaging a lengthwise extending surface of the wand, means responsive to an upward force in the lift cord engaging means provided by tension in the lift cord means for increasing the frictional engagement of the lock means with the wand, and means responsive to a manually applied downward force on the lift member for decreasing the frictional engagement of the lock means with the wand at least sufficient to allow movement of the lift cord operating means along the wand.

23. A window blind according to claim 21 wherein the lock means includes means for frictionally engaging a lengthwise extending surface on the wand, and finger manipulatable means movable with the lift member for selectively actuating said lock means.

24. A window blind according to claim 21 wherein said lift cord operating means includes means responsive to a force applied manually to the lift member in either direction lengthwise of the wand for releasing the lock means at least sufficient to allow movement of the lift cord operating means along the wand.

25. A window blind according to claim 21 wherein the lock means includes means for frictionally engaging a lengthwise extending surface on the wand, said lift cord operating means including means responsive to a force applied manually to the lift member in a direction lengthwise of the wand for releasing the lock means at least sufficient to allow movement of the lift cord operating means along the wand.

* * * * *